US007797910B2

(12) United States Patent
Cash, III et al.

(10) Patent No.: US 7,797,910 B2
(45) Date of Patent: Sep. 21, 2010

(54) LOADING APPARATUS

(75) Inventors: John Cash, III, Dallas, GA (US); Rafe Patterson, Fortson, GA (US); Michael Flagg, Newman, GA (US)

(73) Assignee: MeadWestvaco Corporation, Richmond, VA (US)

( * ) Notice: Subject to any disclaimer, the term of this patent is extended or adjusted under 35 U.S.C. 154(b) by 215 days.

(21) Appl. No.: 12/163,807

(22) Filed: Jun. 27, 2008

(65) Prior Publication Data

US 2009/0038274 A1 Feb. 12, 2009

Related U.S. Application Data

(60) Provisional application No. 60/945,894, filed on Jun. 28, 2007, provisional application No. 60/955,264, filed on Aug. 10, 2007.

(51) Int. Cl.
*B65B 5/06* (2006.01)
*B65B 35/02* (2006.01)
*B65B 43/44* (2006.01)

(52) U.S. Cl. ..... 53/169; 53/250; 53/259; 53/389.1

(58) Field of Classification Search ..... 53/169, 53/249–251, 259, 389.1; 229/125.125
See application file for complete search history.

(56) References Cited

U.S. PATENT DOCUMENTS 2,004,048 A * 6/1935 Guedry ..... 53/569
2,079,778 A 5/1937 Thom
2,472,871 A * 6/1949 Williamson ..... 53/169
2,966,020 A * 12/1960 Bacsak ..... 53/169
3,293,825 A * 12/1966 Schmermund ..... 53/169
3,299,610 A * 1/1967 Webster ..... 53/169
3,368,321 A * 2/1968 Sather et al. ..... 53/569
3,455,086 A * 7/1969 Bescript et al. ..... 53/169
3,818,676 A * 6/1974 Russell et al. ..... 53/169
4,297,826 A * 11/1981 Woertche ..... 53/157
4,594,837 A * 6/1986 Zielke ..... 53/250
4,835,944 A * 6/1989 Herrin ..... 53/169
4,926,616 A * 5/1990 Zielke et al. ..... 53/169
5,561,968 A * 10/1996 Palmer ..... 53/458
5,588,276 A * 12/1996 Terjung et al. ..... 53/169
5,788,114 A * 8/1998 Perego ..... 53/389.1

FOREIGN PATENT DOCUMENTS

GB 2147871 5/1937
GB 2232653 12/1990

* cited by examiner

*Primary Examiner*—Stephen F Gerrity
(74) *Attorney, Agent, or Firm*—MWV Intellectual Property Group

(57) ABSTRACT

A loading apparatus for loading blister cards into sleeves includes a blister card magazine for receiving a stack of blister cards and a sleeve magazine for receiving a stack of sleeves. A loading conveyor moves a lug along a path to load a blister card into a sleeve. A gate releasably retains the sleeve in a loading position as the blister card is loaded into the sleeve. The loading apparatus also includes a hopper that facilitates loading sleeves into the sleeve magazine and sensors that ensure the blister cards are properly loaded into sleeves.

20 Claims, 10 Drawing Sheets

F1

LOADING APPARATUS

CROSS REFERENCE TO RELATED APPLICATIONS

This application claims priority to U.S. Provisional Application No. 60/946,894, filed Jun. 28, 2007, and U.S. Provisional Application No. 60/955,264, filed Aug. 10, 2007, the entirety of which are herein incorporated by reference.

TECHNICAL FIELD

This invention relates generally to packaging machines and, more specifically, to apparatuses for loading blister cards into sleeves.

BACKGROUND

Blister card packages are known in the art, and are particularly useful for enclosing pills and other individual doses of medication in an arrangement that is child-resistant but promotes compliance with a prescribed regimen. One aspect of the blister card inserts is the fragility of the blisters, which usually include a clear substrate with blisters enclosed by a foil film. To protect the blisters from inadvertent release of the contents and undesirable access by children, a blister card is commonly packaged by being inserted into a protective sleeve.

It is desirable to make use of high speed automated packaging technology to load the blister cards into sleeves. However, it is critical that loading errors be minimized to prevent waste, and more importantly, to ensure that unsafe packages are not delivered to users. Accordingly, there is a need for an apparatus that can assemble packaging arrangements efficiently, while ensuring that the packages are properly assembled to achieve the protective and safety objectives of the packaging design.

SUMMARY

The various embodiments of the present invention overcome the shortcomings of the prior art by providing an apparatus for engaging elements of a package. For example, in a first embodiment, the apparatus is configured to package inserts and sleeves. In other embodiments, the apparatus is configured to combine a top and a base of a structure, primary and secondary packaging, an inner structure and an outer structure, combinations thereof, and the like.

The first embodiment of the apparatus includes a first magazine that is configured to stage a stack of inserts and a second magazine that is adjacent to the first magazine. The second magazine is configured to stage sleeves. The first magazine includes a first support surface that is positioned along a segment of a path and the second magazine includes a second support surface that is positioned along a segment of the path. In certain embodiments, the first surface is raised with respect to the second surface to align the predefined number of inserts with an opening in the lowermost sleeve. In such embodiments, the second magazine can be positioned downstream of the first magazine with respect to the direction of movement of the lug along the path.

The apparatus further includes a lug that is configured to move along the path. In certain embodiments, the lug is driven along the path by a conveyor and the magazines include a gap through which the lug travels along an operational portion of the path. Along the operational portion of the path, the lug combines a sleeve and a predefined number of the inserts. For example, the lug can propel the lowermost insert into engagement with the lowermost sleeve.

According to one aspect of the disclosure, the apparatus includes a metering structure that restricts the number of inserts that exit the first magazine. In the first exemplary embodiment, the metering structure is positioned to permit no more than the predefined number of inserts to be propelled into engagement with the lowermost sleeve. The metering structure is positioned between the first magazine and the second magazine and is adjacent to the support surfaces of the magazines.

According to another aspect of the disclosure, a sensor is positioned to detect a target on a lowermost sleeve or a lowermost insert. The sensor can access the target through the gap or through another opening. Where the sensor accesses the target through a gap or opening in the lower end of the magazines, the sensor can be mounted at an angle with respect to the plane of the path and the support surfaces are disposed at a corresponding angle so as to expose the gap for access by the sensor. In such embodiments, the distal end of the lug is shaped and positioned to conform to the angle of the support surfaces. For example, as a quality control measure, the loading apparatus is configured such that a bar code sensor can read a barcode on the lowermost blister card prior to the lowermost blister card being loaded into the lowermost sleeve. Specifically, the plane that is perpendicular to the lowermost blister card is at an acute angle with respect to the plane in which the lugs travel. Other quality control measures include a sensor that verifies that the orientation of each sleeve is correct prior to loading, a mechanism that cooperates with a sensor to verify that the orientation of each blister is correct prior to loading, cameras or proximity sensors that determine when the magazines are empty, sensors that verify each sleeve is loaded with a blister pack, and sensors that verify each blister pack is locked within a sleeve. It should be noted that, as used herein, the term sensor refers to any suitable detection device including but not limited to cameras; motion, sound, heat light, and pressure sensing devices; and the like.

The apparatus further includes a gate that is positioned adjacent to the downstream end of the second magazine. The gate is configured and positioned in relation to the path to stabilize a sleeve as an insert is propelled into the sleeve. Alternatively described, the gate is configured and positioned in relation to the path to releasably retain a sleeve in the second magazine. The gate can be actively controlled or passive. For example, the gate can be a device such as a displaceable roller or an electronically controlled mechanical stopper. In certain embodiments, the speed and position of the lug are synchronized with the open and closed positions of the gate. Also, the lug can be configured to move along the path at a variable speed based at least in part on its position in relation to the lowermost sleeve.

The loading apparatus also includes a hopper that facilitates loading the second magazine with sleeves and a supply assist apparatus that adds groups of sleeves, initially contained in cartons, to the sleeves on the hopper. The supply assist apparatus includes a supply conveyor, and a back pressure apparatus. The supply conveyor includes a trailing plate and a leading plate and is configured to transfer a carton of items from the trailing plate to the leading plate to overturn the carton of items. Once the carton of items is overturned on the leading plate, the back pressure apparatus moves the overturned carton of items from the leading plate to the hopper. In certain embodiments, the hopper includes a conveyor that moves the sleeves toward the upper end of the downstream magazine. In such embodiments, the back pressure apparatus moves overturned cartons onto the conveyor. Both the back pressure apparatus and the conveyor can be controlled to move stacks of items in a flow direction. The back pressure apparatus can include a lug that moves in the flow direction along an operation portion of a path.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
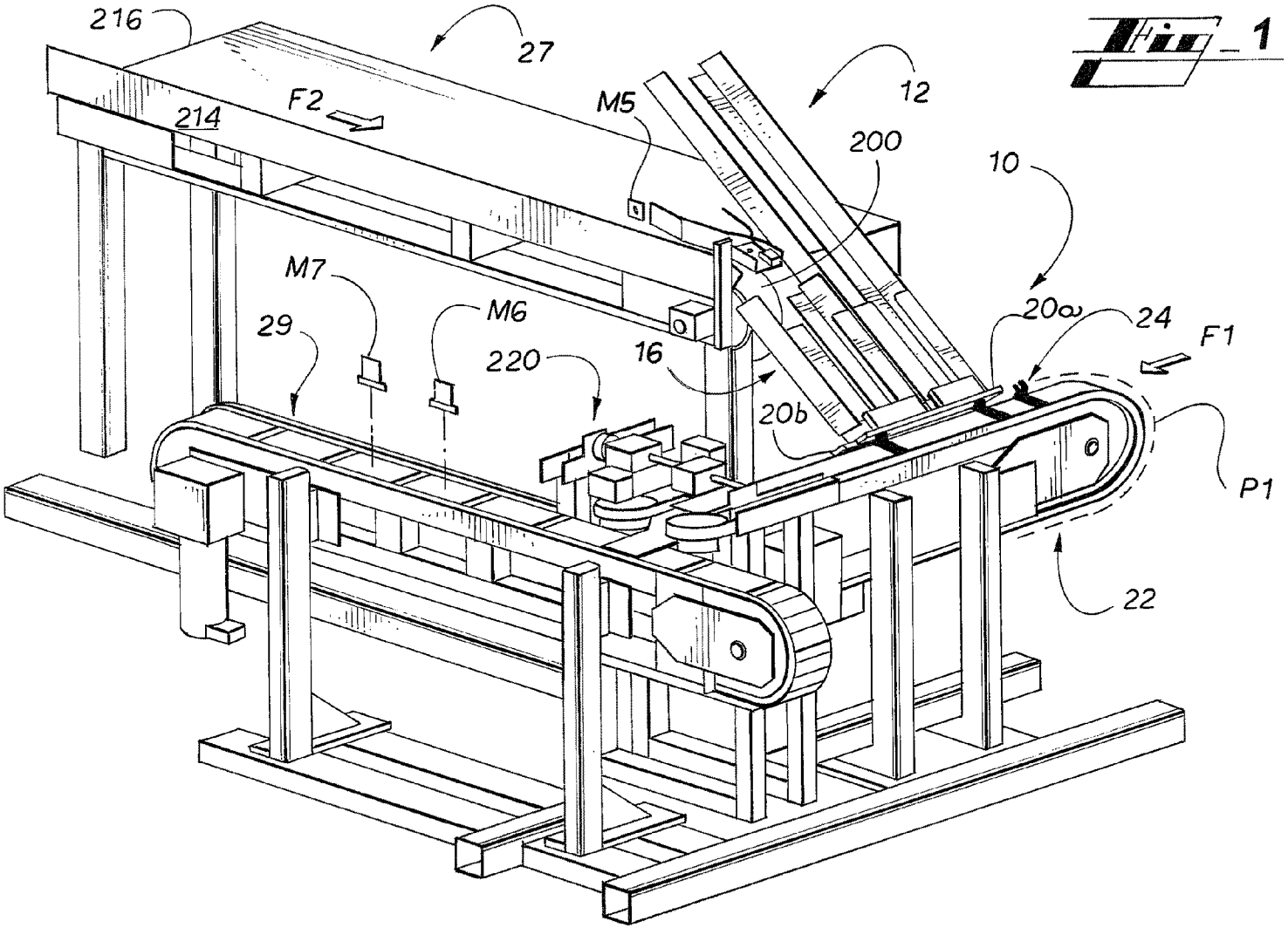
FIG. 1 is a partial perspective view of a loading apparatus, according to an exemplary embodiment of the disclosure.

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Referring now to the drawings, wherein like numerals indicate like elements throughout the several views, the drawings illustrate various aspects of exemplary embodiments of a loading apparatus. The illustrated embodiments of the loading apparatus are configured to load blister cards into sleeves to form packages although it is contemplated that the teachings described herein can be applied to combine, engage, or otherwise package other items. For example, the exemplary loading apparatus can be adapted to load inserts into sleeves, to load cartons with items, to combine parts of a structure, and the like.

Referring to FIG. 1, a first embodiment of a loading apparatus 10 includes a blister card magazine 12 for receiving a stack of blister cards 14 (FIGS. 3 and 4), a sleeve magazine 16 for receiving a stack of sleeves 18 (FIGS. 2-4), plates 20*a*, 20*b*for supporting the blister cards 14 and sleeves 18 in the parallel magazines 12, 16, a loading conveyor 22 with lugs 24 attached thereto for loading the lowermost blister card 14 into the lowermost sleeve 18, and a gate 26 (FIG. 6) that retains the lowermost sleeve 18 in a loading position as the lowermost blister card 14 is loaded therein and releases the lowermost sleeve 18 from the loading position thereafter. The gate 26 illustrated in FIG. 6 includes a spring-loaded roller mechanism described in further detail below. Continuing with FIG. 1, the loading apparatus 10 includes a hopper 27 that feeds the sleeves 18 into the sleeve magazine 16, a supply assist apparatus 28 (shown in FIG. 12) that loads groups of sleeves 18 onto the hopper 27, and a finishing conveyor 29 that moves the loaded sleeves 18, for example, to a labeler (not shown). In addition, devices such as cameras, proxy sensors, and other sensors provide quality control. The loading apparatus 10 is described in further detail below.

The terms "upstream", "downstream", "trailing", and "leading" are used herein with respect to a flow direction and a path, such as a flow direction F1 and a path P1 associated with the lugs 24. The terms can be used to describe the direction of movement of elements or to describe the relative position of elements with respect to one another. Specifically, the terms "upstream" and "downstream" can refer to elements having fixed positions, for example, where a downstream element is positioned at a distance in a flow direction from an upstream element. Downstream movement is movement in a flow direction and upstream movement is movement opposite a flow direction. Further, the terms "leading" and "trailing" can refer to elements that are moving in the flow direction, for example, where the leading element is further along in a flow direction than the trailing element.

The terms "longitudinal" and "transverse" are used herein to describe movement or alignment with respect to a flow direction or to a path. Specifically, the term longitudinal can be used to describe movement or alignment with a flow direction or a path and the term transverse can be used to describe movement or alignment that is substantially perpendicular to a flow direction or a path.

The terms "lower," "lowermost," "upper," and "uppermost" are used herein to describe the relative vertical positions of elements in the magazines 12, 16, particularly in relation to the conveyor surface.

Figure 2:
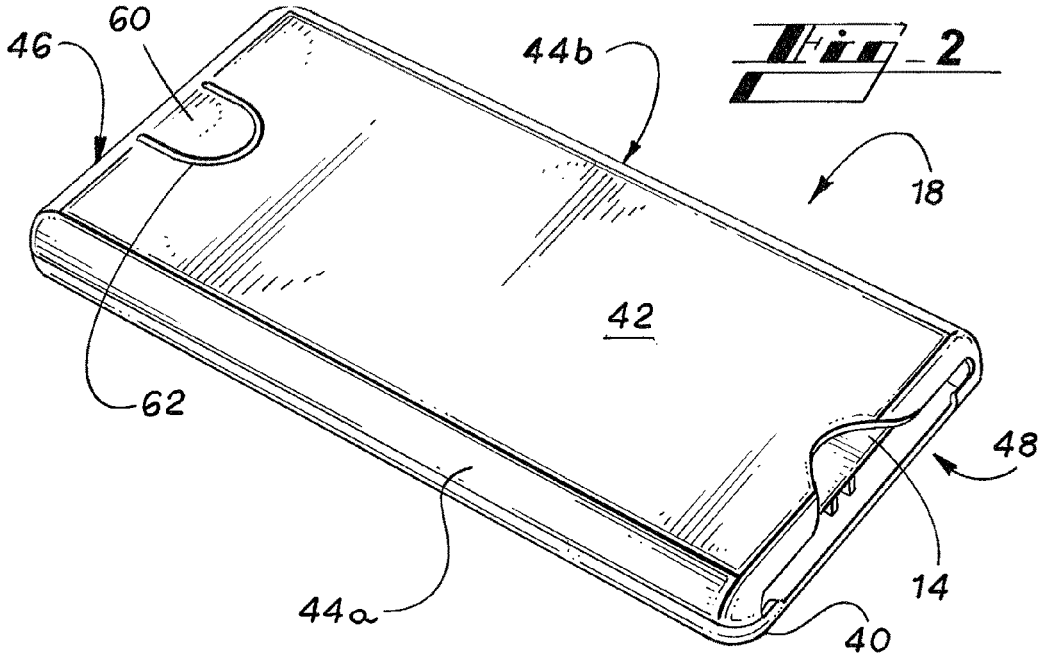
FIG. 2 is a perspective view of a package that includes a sleeve and a blister card, according to an exemplary embodiment of the disclosure.
Figure 3:
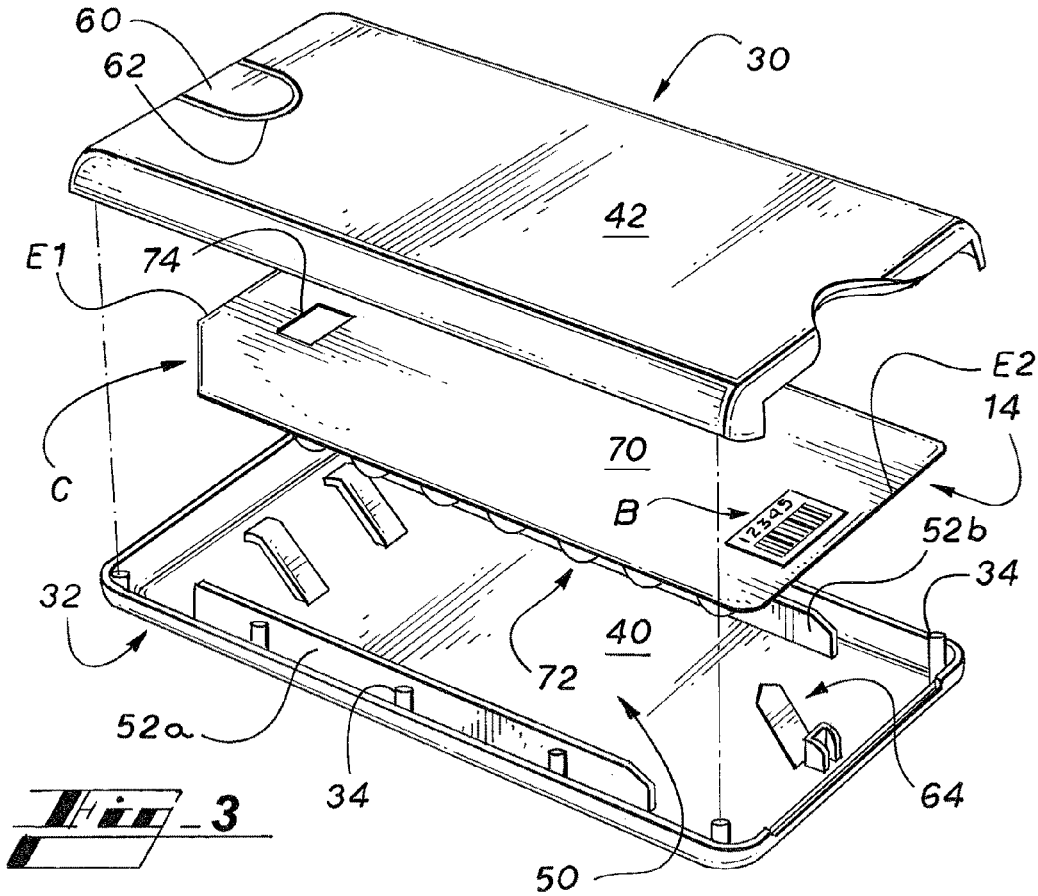
FIGS. 3 and 4 are exploded views of the package of FIG. 2.
Figure 4:
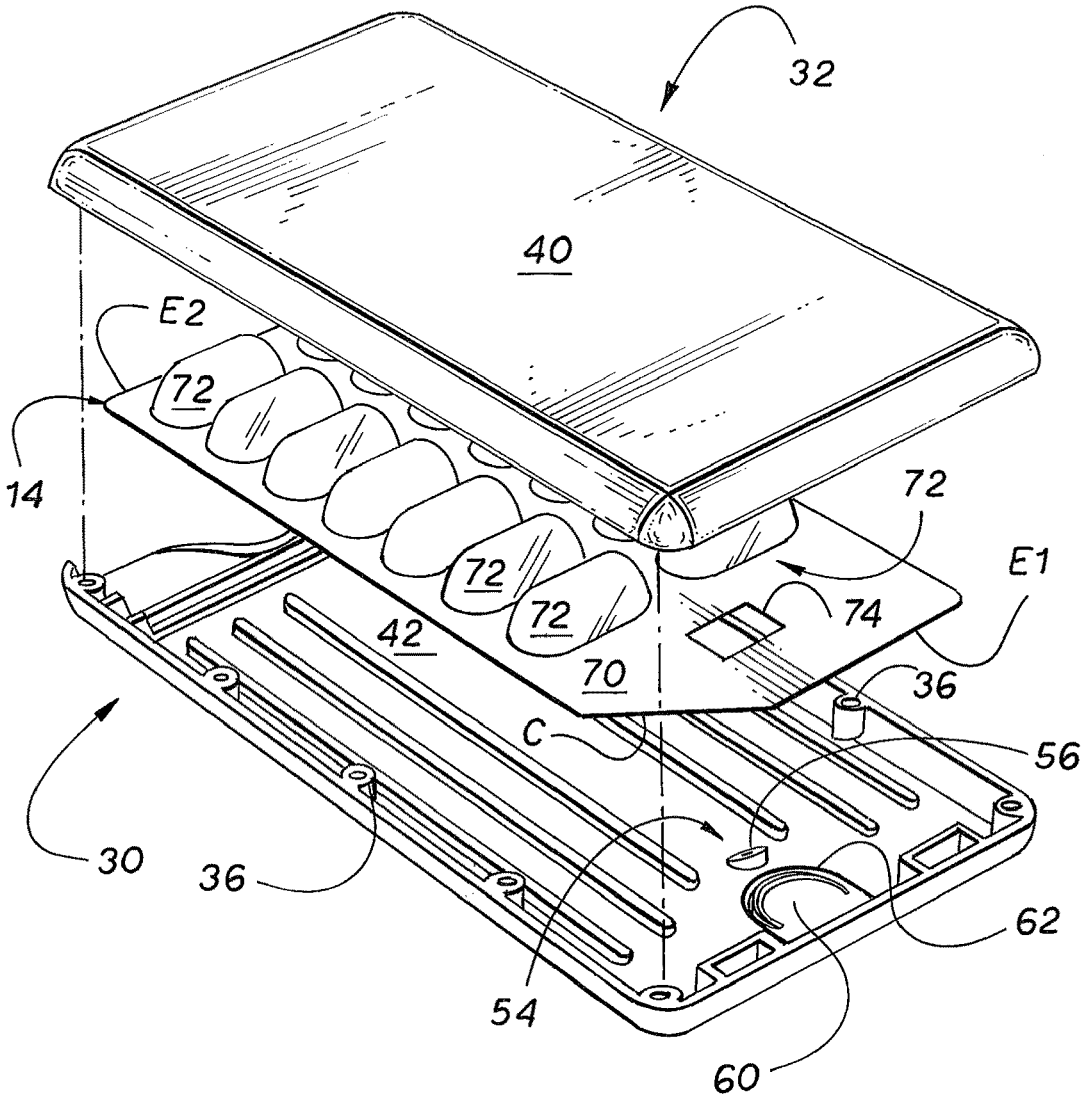

Referring now to FIGS. 2-4, the illustrated sleeve 18 and the illustrated blister card 14 are described in further detail. Referring particularly to FIGS. 3 and 4, the illustrated sleeve 18 is formed from a base portion 30 and a top portion 32 that are attached to one another, as shown in FIG. 2. Specifically, the base portion 30 and the top portion 32 are connected to one another as pegs 34 are press fit in hollow cylinders 36. However, in alternative embodiments, it is contemplated that the sleeve 18 can be a unitary structure or that the portions 30, 32 can be alternatively connected to one another. Furthermore, those skilled in the art will appreciate that the sleeve can be from more than two portions.

The illustrated sleeve 18 includes a top wall 40, a base wall 42, and opposing outer side walls 44*a*, 44*b* that are configured as a tubular structure. One end of the tubular structure is enclosed by an end wall 46 and the other end is a substantially open end 48. In the illustrated embodiment, the open end 48 is dimensioned such that the sleeve 18 only receives a blister card 14 that is properly oriented with respect thereto. The sleeve 18 includes a compartment 50 that is dimensioned to receive the blister card 14 and to align the blister card 14 within the sleeve 18. In the illustrated embodiment, inner side walls of the compartment 50 are ribs 52*a*, 52*b* that are inwardly offset from the outer side walls 44*a*, 44*b*. The compartment 50 is further provided by the top wall 40, the base wall 42, and the end wall 46.

The illustrated sleeve 18 includes an element of a locking mechanism that releasably locks the blister card 14 within the sleeve 18. Specifically, the sleeve 18 includes a protrusion 54 that projects into the compartment 50 from the base wall 42. The protrusion 54 is adjacent the end wall 46 and is shaped so as not to obstruct a leading edge E1 of the blister card 14 as the blister card 14 is received in the compartment 50. Specifically, the protrusion 54 includes a sloped surface 56 that faces the open end 48 of the sleeve 18.

The sleeve 18 also includes a release mechanism to release the elements of the locking mechanism from one another. In the exemplary embodiment, the release mechanism is a push flap 60 that is separated from the top wall 40 by a U-shaped slot 62 so as to be pivotally displaceable into the compartment 50. The push flap 60 is disposed in the base wall 42 between the protrusion 54 and the end wall 46. The sleeve 18 may optionally include a retainer structure 64, positioned near the open end 48, to prevent complete removal of the blister card 14 from the compartment 50.

Generally described, the illustrated sleeve can be substituted with another outer structure such as a shell or carton that is configured to receive an inner structure such as a blister card, insert, or product. In alternative embodiments, the sleeve is formed from a paperboard blank. As mentioned previously, the illustrated loading apparatus can be alternatively configured to accommodate other blister cards and sleeves or other structures that are to be combined.

Continuing with FIGS. 3 and 4, the illustrated blister card 14 is described in further detail. The illustrated blister card 14 includes a planar substrate 70 and a plurality of blisters 72 that are arranged in rows. The blisters 72 typically hold one or more medicaments or other items (not shown). The blister card 14 can include, for example, a tray, which is a plastic sheet in which the blisters 72 are formed, that is attached to a paperboard card such that the planar substrate 70 includes laminated layers of plastic and paperboard and such that items are enclosed in the recesses provided by the blisters 72. Alternatively, a foil backing can be attached to the tray.

The blister card 14 includes an element of the locking mechanism. In the illustrated embodiment, the element is an aperture 74 that is dimensioned and positioned to receive the protrusion 54. The compartment 50 is dimensioned with respect to the blister card 14 such that, when the blister card 14 is received in the compartment 50, the aperture 74 is positioned or aligned to receive the protrusion 54.

The illustrated blister card 14 includes a bar code B, which is printed on or otherwise applied to the planar substrate 70 to identify the product contained in the blister card 14. It should be understood that any code or symbol could alternatively be used and read by a sensor, as described in further detail below. The blister card 14 also includes a chamfered corner C that ensures that the blister card 14 is properly oriented in the blister card magazine 12, as described in further detail below.

The blister cards 14 can be alternatively configured and/or formed according to alternative methods. For example, referring momentarily to FIGS. 6-10, the illustrated blister cards 14 include an alternative number of rows and columns of blisters 72. As another example, the blister cards 14 can taper or narrow towards the leading edge E1 to facilitate loading the blister cards 14 into the sleeves 18.

Figure 5:
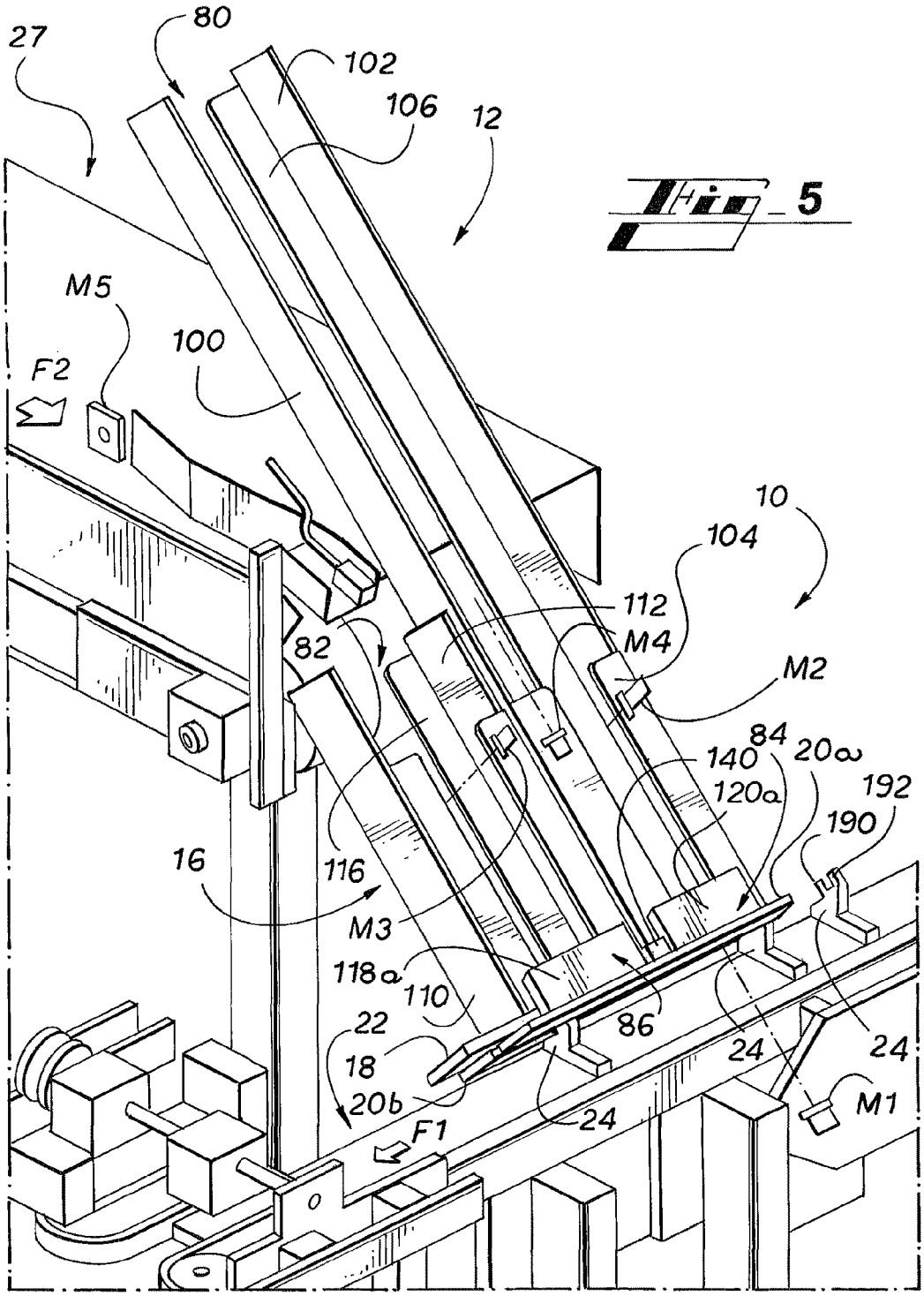
FIG. 5 is a partial perspective view of the loading apparatus of FIG. 1.
Figure 6:
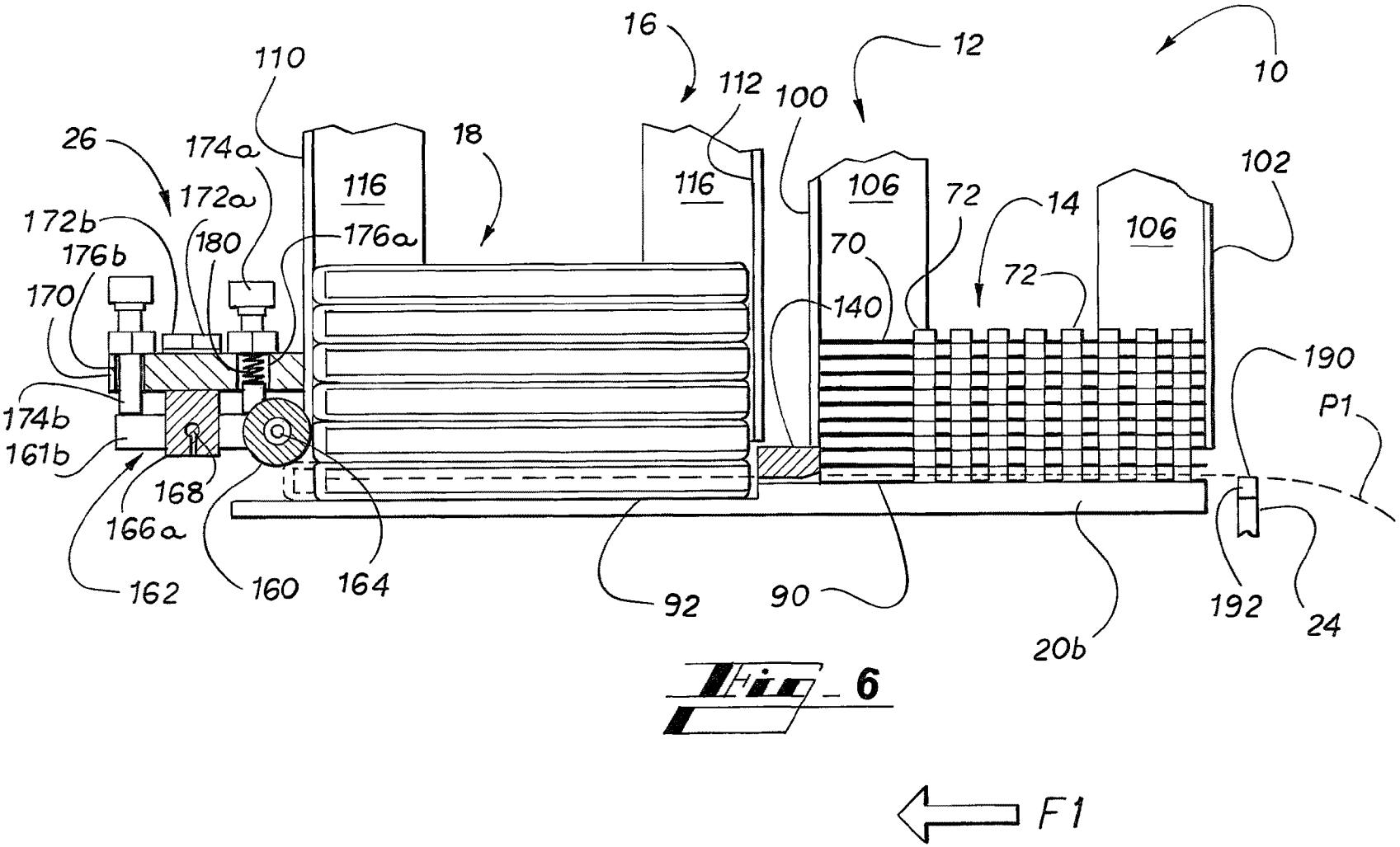
FIG. 6 is a partial cross sectional side elevation view of the loading apparatus of FIG. 1.

Referring to FIGS. 1 and 5-7, the loading apparatus 10 is described in further detail. The blister card magazine 12 and the sleeve magazine 16 are substantially parallel to one another and have open upper ends 80, 82 in which the blister cards 14 and sleeves 18 are loaded, respectively. Lower ends 84, 86 of the blister card magazine 12 and the sleeve magazine 16 are partially closed by the plates 20*a*, 20*b*. The plates 20*a*, 20*b* are positioned at the lower ends 84, 86 to align and support the lowermost blister card 14 and the lowermost sleeve 18 along the operational portion of the path P1 of the distal ends of the lugs 24. Specifically, the lowermost blister card 14 and the lowermost sleeve 18 are aligned and supported on upstream and downstream support surfaces 90, 92, respectively. In the illustrated embodiment, the upstream and downstream support surfaces 90, 92 are the upper surfaces of the plates 20*a*, 20*b*. Referring to FIGS. 6 and 8, the upstream support surface 90 is raised with respect to the downstream support surface 92 so as to align the lowermost blister card 14 with respect to the open end 48 of the lowermost sleeve 18. The upper end 82 of the sleeve magazine 16 extends to the hopper 27, which loads sleeves 18 therethrough, as described in further detail below.

The blister card magazine 12 is dimensioned to receive the blister cards 14 and to arrange the blister cards 14 in a stack that is supported by the upstream support surface 90. Similarly, the sleeve magazine 16 is dimensioned to receive the sleeves 18 and to arrange the sleeves 18 in a stack that is supported by a downstream support surface 92. The illustrated blister card magazine 12 includes walls 100, 102, 104, 106 that are positioned to constrain the stack of blister cards 14 and the illustrated sleeve magazine 16 includes walls 110, 112, 114, 116 that are positioned to constrain the stack of sleeves 18. It is envisaged that the walls of each magazine 12, 16 can be fixed in different positions or otherwise adjustable to change the dimensions of the magazines 12, 16 to accommodate differently dimensioned blister cards 14 and sleeves 18. Additionally, the plates 20*a*, 20*b* can be adjusted or substituted with differently dimensioned plates.

Referring to FIGS. 1, 5 and 6, the transversely extending walls 100, 102, 110, 112 of the parallel magazines 12, 16 do not extend all the way to the plates 20*a*, 20*b* such that the lowermost blister card 14 and the lowermost sleeve 18 can exit the parallel magazines 12, 16 in the flow direction F1. The longitudinally extending walls 104, 106, 114, 116 of the parallel magazines 12, 16 extend to the plates 20*a*, 20*b* so as to constrain the movement of the lowermost blister card 14 and lowermost sleeve 18 to the flow direction F1. In the illustrated embodiment, the longitudinally extending walls 104, 106, 114, 116 include openings and detachable plates 118*a*, 118*b*, 120*a*, 120*b* (118*b*, 120*b* obstructed in FIG. 1) that facilitate access to the blister cards 14 and sleeves 18, for example, in the event that the blister cards 14 or sleeves 18 jam during the loading process.

Figures 7, 11:
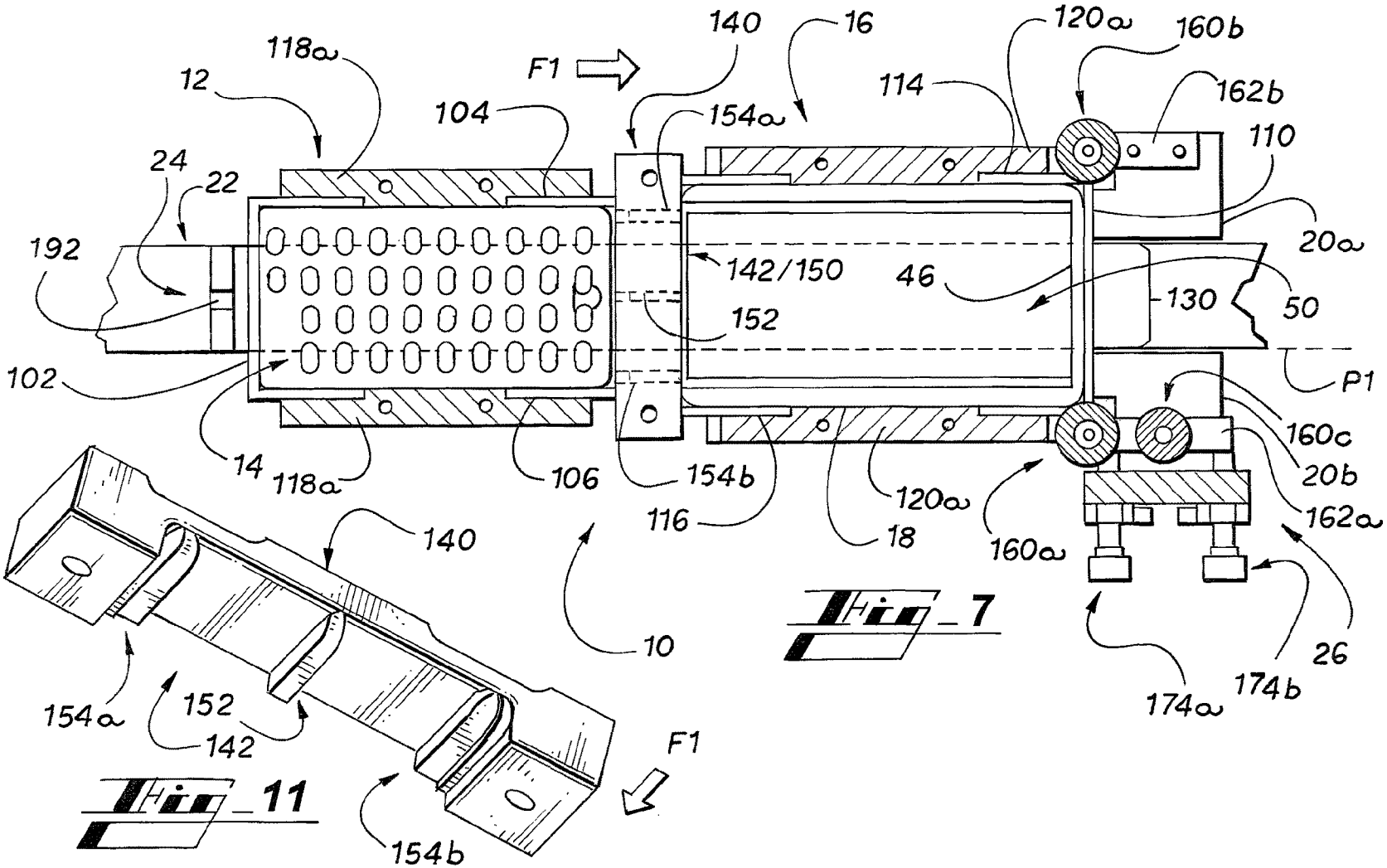
FIG. 7 is a partial cross sectional plan view of the loading apparatus of FIG. 1.
FIG. 11 is a perspective view of a metering block of a the loading apparatus of FIG. 1.
Figure 8:
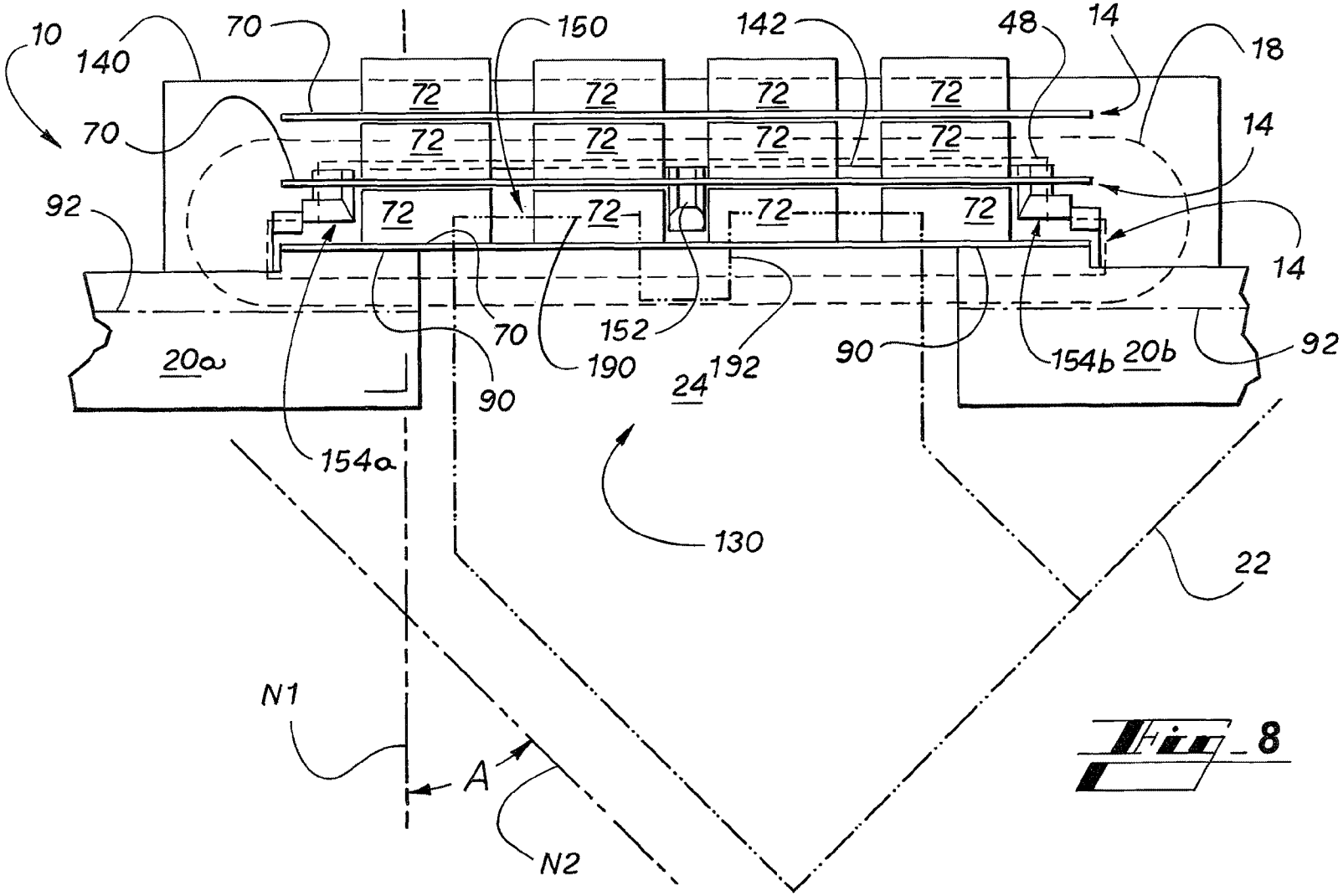
FIG. 8 is a partial end elevation view of the loading apparatus of FIG. 1.

Referring to FIGS. 7, and 8, the plates 20*a*, 20*b* are spaced apart to provide a gap 130 therebetween. The plates 20*a*, 20*b* are positioned with respect to the loading conveyor 22 such that a plane N1, which is substantially perpendicular to the upstream and downstream support surfaces 90, 92, is at an acute angle with respect to a plane N2 in which the lugs 24 travel. In other words, the path P1 of the lugs 24 lies within or is parallel to the plane N2. With this configuration, a bar code sensor M1 (as shown in FIG. 5) can be positioned to read a target such as the barcode B on the lowermost blister card 14 through the gap 130 without being obstructed by the lugs 24 traveling in plane N2. In the illustrated embodiment, the barcode B is read as the lowermost blister card 14 rests on the upstream support surface 90 prior to being loaded into the lowermost sleeve 18.

Figure 9:
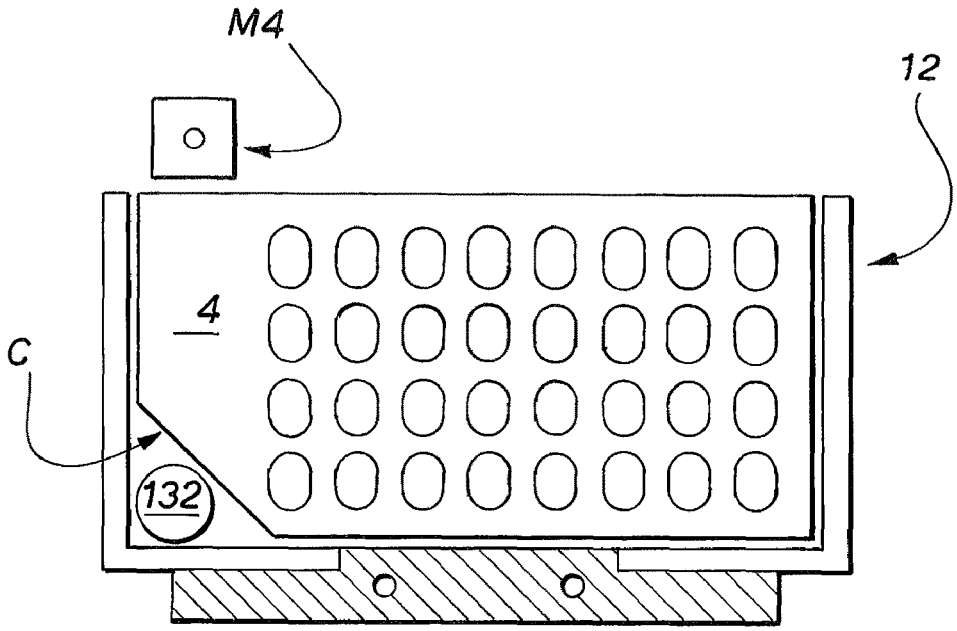
FIGS. 9 and 10 are cross-sectional views of a blister card magazine of the loading apparatus of FIG. 1.
Figure 10:
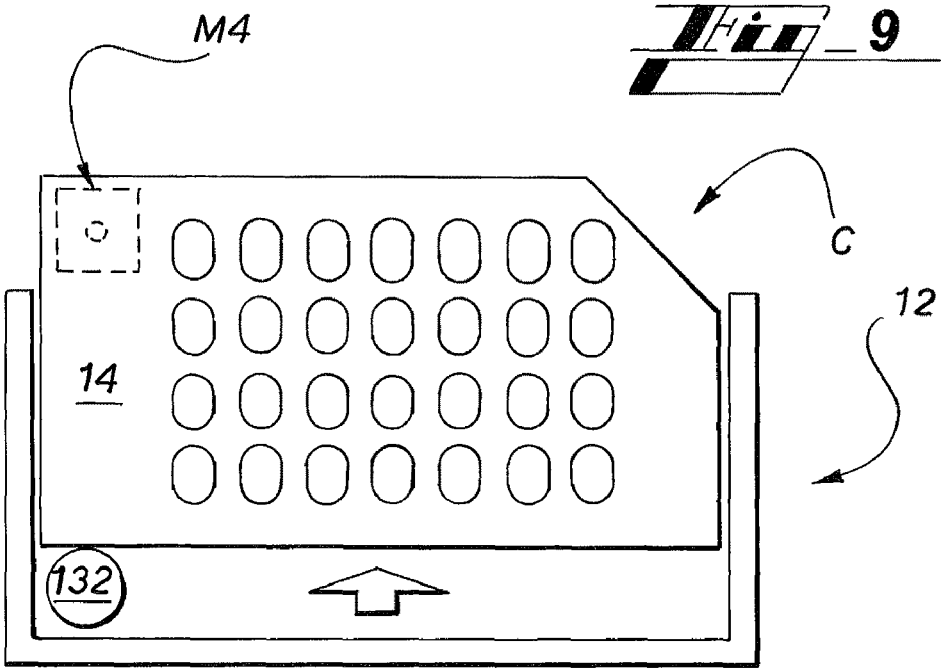

Referring to FIGS. 1 and 5, empty magazine sensors M2, M3 such as proximity sensors are positioned along the length of the parallel magazines 12, 16, respectively, to signal when the magazines 12, 16 are near empty or empty. A blister orientation sensor M4 such as a proximity sensor is also positioned along the blister card magazine 12 to signal when a blister card 14 is incorrectly oriented in the blister card magazine 12. Referring to FIGS. 9 and 10, the blister card magazine 12 includes an ejecting structure 132, such as a bar, that cooperates with the chamfered corner C of the blister card 14. The ejecting structure 132 is adjacent, without substantially contacting, the chamfered corners C of blister cards 14 that are properly oriented and contacts and displaces blister cards 14 that are not properly oriented. Displaced blister cards 14 are recognized by the blister orientation sensor M4 and are removed from the blister card magazine 12, for example, by an operator.

The loading apparatus 10 includes a metering structure that is configured to permit a single blister card 14 to be pushed from the blister card magazine 12 by the lug 24 and to align the blister card 14 with the corresponding sleeve 18. In alternative embodiments, the metering structure permits a selected number of blister cards that is more than one to be pushed from the magazine. Referring to FIGS. 5-8, and 11, the illustrated metering structure is a metering block 140 that is positioned at the downstream end of the upstream support surface 90 and between the parallel magazines 12, 16. The metering block 140 includes a recess 142 that, along with the upstream support surface 90, provides a metering opening 150 between the lower ends 84, 86 of the magazines 12, 16. Generally described, the profile of the illustrated metering opening 150 is dimensioned to fit the profile of the blister card 14 such that only the lowermost blister card 14 to is allowed to pass through the metering opening 150. Further, the profile of the recess 142 is tapered to facilitate receiving and aligning the lowermost blister card 14 as the lowermost blister card 14 moves in the flow direction F1 through the metering opening 150.

Referring particularly to FIG. 10, the metering block 140 includes integrally formed guides, although separable elements are contemplated as well. A center guide 152 and outer edge guides 154*a*, 154*b* shape the profile of the recess 142 and extend in between and adjacent rows of blisters 72 of the lowermost blister card 14 such that the metering opening 150 is tightly toleranced around the lowermost blister card 14. Accordingly, the lowermost blister card 14 is aligned by the metering opening 150. The upstream ends of the guides 152, 154*a*, 154*b* are tapered such that the leading edge E1 of the lowermost blister card 14 is easily received the upstream end of the metering opening 150 and, as the lowermost blister card 14 continues through the metering opening 150, the metering opening 150 narrows around the lowermost blister card 14. The guides 152, 154*a*, 154*b* also function to obstruct the blister card 14 that rests on the lowermost blister card 14.

Referring now to FIGS. 6 and 7, the gate 26 is positioned downstream of and adjacent the lower end 86 of the sleeve magazine 16. FIG. 6 illustrates a first configuration of the gate 26 and FIG. 7 illustrates a second configuration of the gate 26. Each gate 26 configuration includes a displaceable roller 160 that is positioned to contact the leading end of the lowermost sleeve 18, or otherwise the end wall 46, to retain the lowermost sleeve 18 in the loading position. The roller 160 is displaceable to release the lowermost sleeve 18 from the loading position. The loading position can be described as the position at which the open end 48 of the lowermost sleeve 18 is adjacent the metering opening 150. However, the lowermost sleeve 18 may be able to slightly shift in the flow direction F1 before being contacted by the roller 160.

The roller 160 illustrated in FIG. 6 is connected to a mechanism that permits the roller 160 to be vertically displaceable. The roller 160 is rotatably connected to an end of a rotatable arm 162 by a pin 164. The arm 162 is rotatably connected between blocks 166*a*, 166*b* (166*b* obstructed in figures) by a pin 168. Accordingly, the roller 160 can displace as the arm 162 rotates about the pin 168 and can rotate about the pin 164 to roll, for example, along a wall of the lowermost sleeve 18. The blocks 166*a*, 166*b* are attached to a basis plate 170 by bolts 172*a*, 172*b*. Stopper bolts 174*a*, 174*b* extend through apertures 176*a*, 176*b* in the basis plate 170 to contact opposing ends of the arm 162 to control the initial and displaced positions of the roller 160. The stopper bolt 174*a* has a structure that can be biased or compressed to allow displacement of the roller 160 and that can be adjusted to control resistance to displacement of the roller 160. Specifically, the illustrated stopper bolt 174*a* has a spring 180, although a compressible stopper bolt and a flexible arm are contemplated. The roller 160*a* illustrated in FIG. 6 has substantially the same structure and is oriented to be horizontally displaceable.

In general, the vertically displaceable roller 160 of the embodiment of FIG. 6 and the horizontally displaceable roller 160*a* of the embodiment of FIG. 7 function in substantially the same manner. However, in the FIG. 6 embodiment, there are frictional forces between the base wall 42 and the downstream support surface 92 as the roller 160 rolls across the top wall 40. Further, the roller 160 may crush the top wall 40 of certain sleeve 18 types or collapse the top wall 40 to crush the blister card 14 therein. In the FIG. 7 embodiment, the rollers 160*a*, 160*b* are positioned on opposed sides of the lowermost sleeve 18 to reduce frictional forces on the sleeve 18. Further, since certain sleeve 18 types are better suited to support loads on the side walls 44*a*, 44*b* rather than on the top wall 40 and base wall 42, positioning the rollers 160*a*, 160*b* to roll across the side walls 44*a*, 44*b* is advantageous for such sleeve 18 types. In addition, the position and orientation of the horizontally displaceable rollers 160*a*, 160*b* can allow the lowermost sleeve 18 to be contacted by the rollers 160*a*, 160*b* further upstream from where the lowermost sleeve 18 would be contacted by the vertically displaceable roller 160. Thus, the horizontally displaceable rollers 160*a*, 160*b* reduce or eliminate shifting of the lowermost sleeve 18 during the loading process.

In the illustrated FIG. 7 embodiment, the roller 160*b* has a fixed position and the roller 160*a* is displaceable. In alternative embodiments, it is envisaged that each of the rollers 160*a*, 160*b* is displaceable. In addition, a guide roller 160*c* guides the lowermost sleeve 18 in the flow direction F1 and prevents contact between the arm 162*a* and the lowermost sleeve 18 once the roller 160*a* and arm 162*a* are deflected to release the lowermost sleeve 18.

In other alternative embodiments, a roller may be pinned in a fixed position and be formed from rubber or urethane or otherwise have a compressible surface that displaces. In such embodiments, the elements that provide the spring loaded mechanism can be omitted. Further, if there is sufficient deformability in the sleeve 18, a roller may be pinned in a fixed position and made of a material that is substantially rigid.

Referring now to FIGS. 1 and 5-8, the loading conveyor 22 includes lugs 24 that can move along the circuit path P1. The loading conveyor 22 can include carrier chains (not shown) that are tensioned around sprockets (not shown) and plates that are attached to the carrier chains to provide a supporting surface. The lugs 24 can be detachably connected to certain of the plates of such a loading conveyor 22 and the sprockets can be driven by a servo-motor to move the chains, plates, and lugs 24 along the path P1. In other embodiments, the lugs 24 can be attached directly to the carrier chains. It is envisaged that known and yet to be developed conveyors can be adapted to provide the functionality described herein.

The loading conveyor 22 is positioned below and adjacent the plates 20*a*, 20*b* such that the lugs 24 move through the gap 130 in the flow direction F1 along an operational portion of the path P1. The distal end 190 of each lug 24 is angled with respect to the plane N2 so as to be substantially parallel to the plane N1. The distal end 190 extends into the gap 130, slightly above the upstream support surface 90 so as to contact only the lowermost blister card 14, and slightly above the downstream support surface 92 so as to contact only the lowermost sleeve 18. The distal end 190 of the lug 24 includes a notch 192 that corresponds to the profile of the recess 142 so that the lug 24 is not obstructed by the metering block 140 as the lug 24 moves through the metering opening 150. Specifically, the notch 192 is dimensioned and positioned to avoid contact with the central guide 152. The lug 24 can be alternatively shaped to accommodate other recess 142 profiles.

As described in further detail below, the speed at which the loading conveyor 22 moves the lugs 24 along the path P1 can be constant or variable, for example, so as to follow a cam profile.

Figure 12:
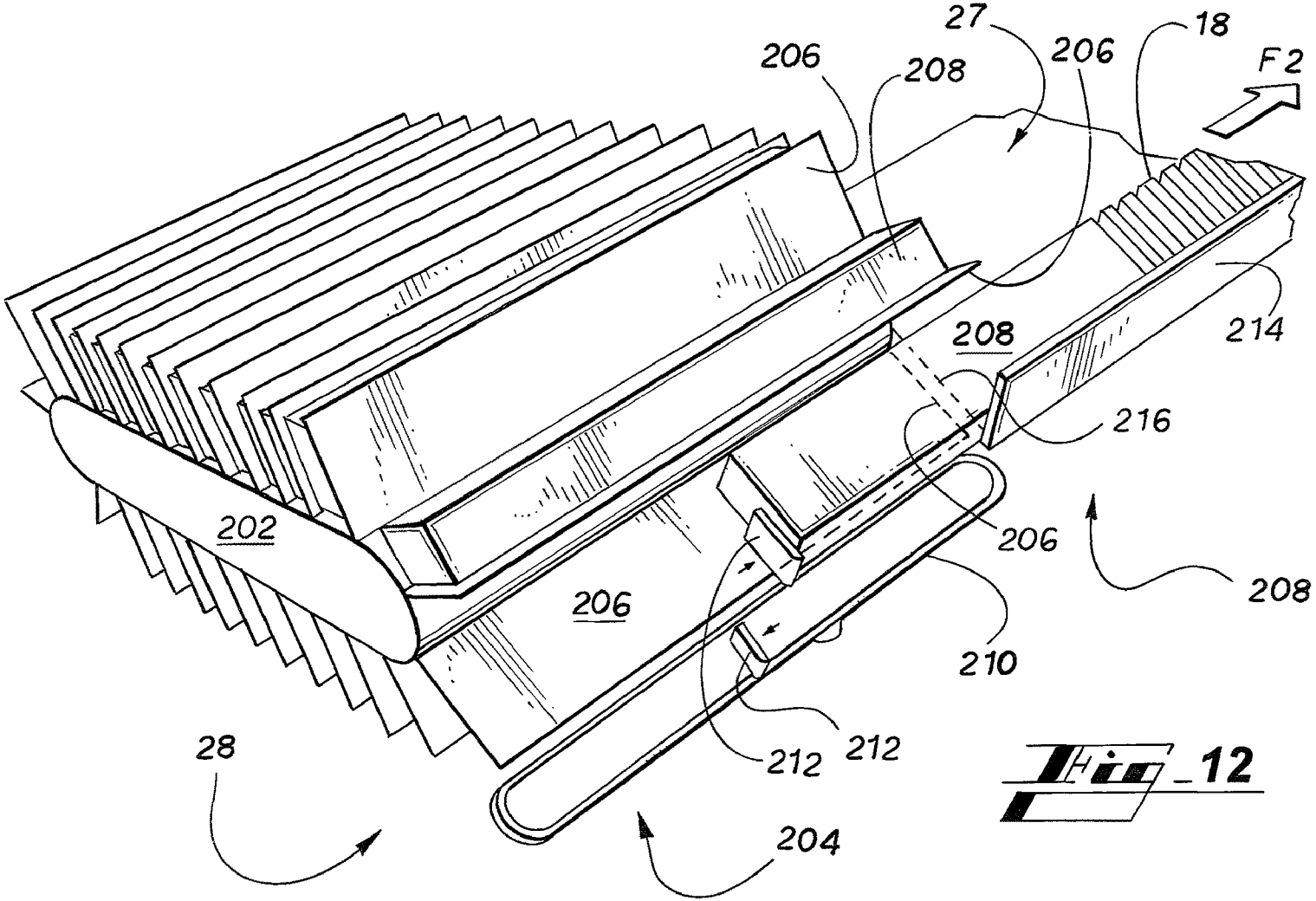
FIG. 12 is a partial perspective view of a hopper and a supply assist apparatus of the loading mechanism of FIG. 1.

Referring now to FIGS. 1 and 12, the hopper 27 and the supply assist apparatus 28 are described in further detail. The hopper 27 includes a conveyor belt 200 on which sleeves 18 are placed. The conveyor belt 200 moves the sleeves 18 in a flow direction F2 along a path toward the upper end 82 of the sleeve magazine 16. The illustrated hopper 27 includes a support wall 214 that extends along the length of the conveyor belt 200 and facilitates arranging the sleeves 18 in a line. The sleeves 18 are placed on the conveyor belt 200 with open ends 48 thereof configured to face upstream with respect to the flow direction F1 and the end walls 46 of the sleeves 18 substantially abut the support wall 214. A shell orientation sensor M5 (FIG. 1) is positioned along the length of the hopper 27 to verify that the sleeves 18 are properly oriented. In the illustrated embodiment, the sleeves 18 and the blister cards 14 are properly oriented when the profiles of the open ends 48 and the end profiles of the blister cards 14 match up.

Referring to FIG. 12, the supply assist apparatus 28 is disposed at the upstream end 216 of the hopper 27, with respect to the flow direction F2, and includes a supply conveyor 202 and a back pressure apparatus 204. The supply conveyor 202 includes plates 206 between which cartons 208 containing sleeves 18 are loaded. The supply conveyor 202 moves the plates 206 along a path, the operational portion of which is angled upwardly. The bottom end of each carton 208 is initially supported by a trailing plate 206 and the top end of each carton 208 is open. Near the upper end of the operational portion of the path, the plates curve around an end of the supply conveyor 202 and each carton 208 is overturned such that the sleeves 18 are supported by a leading plate 206. The sleeves 18 then rest on the leading plate 206 and the overturned carton continues to hold the sleeves 18 together as a group. The leading plate 206 is thereafter positioned to be substantially coplanar with the hopper 27. Accordingly the overturned carton 208 of sleeves 18 is aligned with the sleeves 18 on the hopper 27.

The illustrated back pressure apparatus 204 includes a conveyor 210 with lugs 212 that push the overturned carton 208 of sleeves 18 from the leading plate 206 in the flow direction F2 to abut the trailing end of a line of sleeves 18, which may include an overturned carton 208 of sleeves 18, such that the line of sleeves 18 on the hopper 27 does not topple. Once an overturned carton 208 of sleeves 18 has been pushed onto the hopper 27 and is abutted by a trailing overturned the carton 208 of sleeves, the leading overturned carton 208 can be easily removed by an operator so that the sleeves 18 remain upright and can be moved into the sleeve magazine 16 by the conveyor belt 200. The back pressure apparatus 204 and the conveyor belt 200 are synchronized to keep the line of sleeves 18 upright and to move the line of sleeves 18 to the sleeve magazine 16.

Referring to FIG. 1, the finishing conveyor 29 is now described in further detail. The flow direction of the finishing conveyor 29 is substantially perpendicular to the flow direction F1. It should be noted that the finishing conveyor 29 can move the packaged sleeves 18 in the flow direction F2 or against the flow direction F2. To account for changes in direction, speed, and pitch between the loading conveyor 22 and the finishing conveyor 29, a buffer device 220 is positioned therebetween to collect packages from the loading conveyor 22 and to place the packages on the finishing conveyor 29. It is contemplated that changes in speed and direction are useful to interface with, for example, a labeling apparatus. However, in alternative embodiments, the finishing conveyor 29 and the loading conveyor 22 can be one in the same or parallel to one another.

The illustrated loading apparatus 10 includes an empty pack sensor M6 and a no-lock sensor M7, each positioned above the finishing conveyor 29. The empty pack sensor M6 verifies that each sleeve 18 is loaded with a blister card 14 and the no-lock sensor M7 verifies that each blister card 14 is fully received and releasably locked in a sleeve 18.

An exemplary method of operation of the loading apparatus 10 is now described. Referring to FIG. 1, a stack of blister cards 14 is loaded into the blister card magazine 12 through the upper end 80 and a stack of sleeves 18 is loaded into the sleeve magazine 16 through the upper end 82 by the hopper 27 and supply assist apparatus 28. When loaded in the parallel magazines 12, 16, the blister cards 14 and the sleeves 18 are arranged with respect to one another such that respective ones thereof can be combined. Specifically, the blister cards 14 are loaded into the blister card magazine 12 such that the blisters 72 of each blister card 14 face upwardly and such that the leading edge E1 of each blister card 14 is furthest downstream. The sleeves 18 are loaded into the sleeve magazine 16 such that the open end 48 of each sleeve 18 faces upstream with respect to the flow direction F1 or is the trailing end and such that the base wall 42 is the lowermost wall. Thus, the leading edges E1 of the blister cards 14 are adjacent the trailing open ends 48 of the sleeves 18.

Referring to FIG. 6, as the lowermost blister card 14 is supported by the upstream support surface 90 and the lowermost sleeve 18 is supported by the downstream support surface 92, the lowermost blister card 14 is substantially centered and aligned with the open end 48 of the sleeve 18 and the metering opening 150. The upstream support surface 90 is raised with respect to the downstream support surface 92 such that the leading edge E1 of the lowermost blister card 14 is not obstructed by the trailing end of the base wall 42, which is adjacent the open end 48 of the lowermost sleeve 18.

Referring to FIGS. 5-8, one of the lugs 42 follows the path P1 and, along an operational portion of the path P1, enters the upstream end of the gap 130. As the lug 24 continues along the length of the gap 130 in the flow direction F1, the distal end 190 of the lug 24 contacts a trailing edge E2 of the lowermost blister card 14, but does not contact the other blister cards 14 in the blister card magazine 12. Friction between the lowermost blister card 14 and the blister card 14 that rests on the lowermost blister card 14 can apply a pulling force to the resting blister card 14. However, the profile of the metering opening 150 prevents the resting blister card 14 from moving through the metering opening 150 along with the lowermost blister card 14.

The lug 24 continues in the flow direction F1 to push the lowermost blister card 14 through the metering opening 150, through the open end 48 and into the compartment 50 of the lowermost sleeve 18. As the lowermost blister card 14 is received in the lowermost sleeve 18, the roller 160 contacts the end wall 46 to maintain the position of the lowermost sleeve 18. The retention force provided by the roller 160 is selected so as to overcome any frictional forces or contact forces between the lowermost blister card 14 and the lowermost sleeve 18. In other words, the roller 160 prevents the pushing force applied by the lug 24 to load the lowermost blister card 14 into the lowermost sleeve from displacing the lowermost sleeve 18.

Once the lowermost blister card 14 is fully received and releasably locked within the lowermost sleeve 18, the blister card 14 and sleeve 18 are together referred to as a package. The aperture 74 receives the protrusion 54 to releasably lock the blister card 14 in the sleeve 18.

Now that the lug 24 has passed through the metering opening 150, the lug 24 contacts and applies a force to the lowermost sleeve 18 that is great enough to overcome the retention force applied by the roller 160. Specifically, as the lug 24 pushes against the lowermost sleeve 18, the roller 160 is displaced, the spring 180 is biased or compressed, and the roller 160 rolls across the top wall 40 of the lowermost sleeve 18 as the lowermost sleeve continues in the flow direction F1. Once the package is pushed past the roller 160, the process is repeated for the subsequent lowermost blister card 14 and sleeve 18. Specifically, the blister card 14 and sleeve 18 that are now lowermost in the parallel magazines 12, 16 or are otherwise now supported by the upstream and downstream support surfaces 90, 92.

In alternative embodiments, the loading apparatus 10 can includes a known or yet to be developed vibrator that vibrates the magazines 12, 16 to facilitate movement of the stacks of blister cards 14 and sleeves 18 toward the lower ends 84, 86. In still other alternative embodiments, the metering opening 150 is configured to permit a predefined number of blister cards 14 to be loaded substantially simultaneously into a single sleeve 18.

Figure 13:
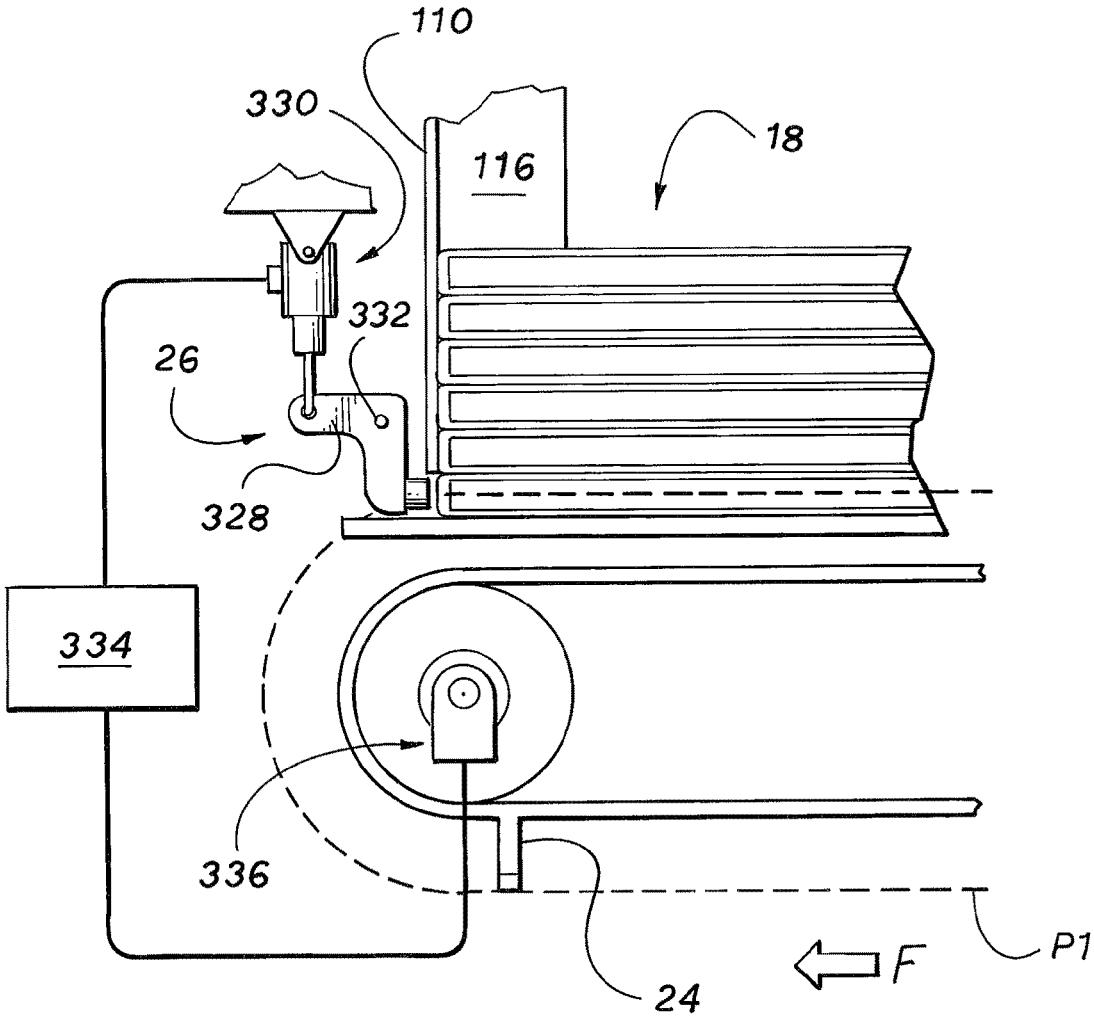
FIG. 13 is a partial cross sectional side elevation view of a loading apparatus, according to an alternative exemplary embodiment of the disclosure.

Referring to an alternative embodiment illustrated in FIG. 13, a loading apparatus 10 includes a gate 26 that is controlled. The illustrated gate 26 includes a stopper 328 that is connected to a piston 330. In a closed position, the stopper 328 contacts the end wall 46 of the lowermost sleeve 18 as the lowermost blister card 14 is loaded into the lowermost sleeve 18 and retains the lowermost sleeve 18 in the loading position. In an open position, the stopper 328 releases the loaded lowermost sleeve 18 from the loading position. To open the gate 26, the piston 330 is retracted such that the stopper 328 rotates outwardly about a pin connection 332. To close the gate 26, the piston 330 is extended.

The rotation of the stopper 328 is timed with respect the movement of the lugs 24 along the path P1. In the illustrated embodiment, a controller 334 controls both the piston 330 and a motor 336 that drives the loading conveyor 22 so as to synchronize the movement and position of the stopper 328 with the movement and position of the lugs 24 along the path P1.

The speed of the lugs 24 along the path P1 can be controlled so as to be constant or variable. In certain embodiments, it is beneficial to vary the speed along the length of the path P1 to prevent damage to the blister cards 14 and sleeves 18 by slowing the lugs 24 down just before contacting the blister cards 14 and sleeves 18. Further, the speed can be controlled to slow the lugs 24 down just before contacting the sleeves 18 so as to allow the stopper 328 more time to clear or open. Along most other lengths of the path P1, the speed of the lugs 24 is maximized to increase the efficiency of the loading process.

The above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

The invention claimed is:

1. An apparatus for engaging inserts and sleeves, comprising:

a first magazine having a lower end and configured to stage inserts, the first magazine comprising a first support surface provided by at least one plate for supporting the inserts in the first magazine;

a second magazine adjacent the first magazine, the second magazine having a lower end and being configured to stage sleeves, the second magazine comprising a second support surface provided by the at least one plate for supporting the sleeves in the second magazine; and at least one lug that is configured to move along a path of the at least one lug so as to propel a predefined number of the inserts into engagement with a lowermost sleeve, wherein the at least one plate is positioned such that the predetermined number of inserts and the lowermost sleeve are brought into alignment along the path of the at least one lug when supported on the first and second surfaces respectively.

2. The apparatus of claim 1, wherein the second magazine is downstream of the first magazine with respect to a direction of movement of the at least one lug along the path.

3. The apparatus of claim 1, wherein the at least one lug is driven by a conveyor.

4. The apparatus of claim 1, further comprising a metering structure positioned to permit no more than the predefined number of the inserts to be propelled into engagement with the lowermost sleeve.

5. The apparatus of claim 4, the metering structure being positioned between the first magazine and the second magazine.

6. The apparatus of claim 4, the metering structure being adjacent at least one of the first support surface and the second support surface.

7. The apparatus of claim 1, wherein the lower ends of the first and second magazines are partially closed by the at least one plate.

8. The apparatus of claim 1, wherein the at least one plate is fixedly disposed with respect to the first and second magazines.

9. An apparatus for engaging inserts and sleeves, comprising:

a first magazine configured to stage inserts, comprising a first support surface that is positioned along a segment of a path;

a second magazine adjacent the first magazine, the second magazine being configured to stage sleeves, comprising a second support surface that is positioned along a segment of the path; and at least one lug that is configured to move along the path so as to propel a predefined number of the inserts into engagement with a lowermost sleeve, wherein the second magazine is downstream of the first magazine with respect to a direction of movement of the at least one lug along the path, and wherein the first support surface is raised with respect to the second support surface to align the predefined number of the inserts with an opening in the lowermost sleeve.

10. The apparatus of claim 9, further comprising a gate that is positioned adjacent the downstream end of the second magazine.

11. The apparatus of claim 10, wherein the gate is configured and positioned in relation to the path so as to stabilize a sleeve as the predefined number of the inserts is propelled into the sleeve.

12. The apparatus of claim 9, the at least one lug being configured to move along the path at a variable speed based at least in part on its position in relation to the lowermost sleeve.

13. An apparatus for engaging inserts and sleeves, comprising:

a first magazine configured to stage inserts, comprising a first support surface that is positioned along a segment of a path;

a second magazine adjacent the first magazine, the second magazine being configured to stage sleeves, comprising a second support surface that is positioned alone a segment of the path;

at least one lug that is configured to move along the path so as to propel a predefined number of the inserts into engagement with a lowermost sleeve; and a sensor positioned to detect a target on the lowermost sleeve or a lowermost insert;

wherein at least one of the first support surface and the second support surface is positioned and configured to define a gap through which the sensor can access the target.

14. The apparatus of claim 13, wherein the sensor is mounted at an angle with respect to the plane of the path, and at least one of the first support surface and the second support surface is disposed at a corresponding angle so as to expose the gap for access by the sensor.

15. The apparatus of claim 14, wherein the distal end of the at least one lug is shaped and positioned to conform to the angle of the at least one of the first support surface and the second support surface that is angled.

16. An apparatus for engaging inserts and sleeves, comprising:

a first magazine configured to stage inserts, comprising a first support surface that is positioned along a segment of a path;

a second magazine adjacent the first magazine, the second magazine being configured to stage sleeves, comprising a second support surface that is positioned along a segment of the path; and at least one lug that is configured to move along the path so as to propel a predefined number of the inserts into engagement with a lowermost sleeve, wherein the second magazine is downstream of the first magazine with respect to a direction of movement of the least one lug along the path, wherein the apparatus further comprises a gate that is positioned adjacent the downstream end of the second magazine, and wherein the gate is configured and positioned in relation to the path so to releasably retain a sleeve in the second magazine.

17. An apparatus for engaging inserts and sleeves, comprising:

a first magazine configured to stage inserts, comprising a first support surface that is positioned along a segment of a path;

a second magazine adjacent the first magazine, the second magazine being configured to stage sleeves, comprising a second support surface that is positioned along a segment of the path; and at least one lug that is configured to move along the path so as to propel a predefined number of the inserts into engagement with a lowermost sleeve, wherein the second magazine is downstream of the first magazine with respect to a direction of movement of the at least one lug along the path, wherein the apparatus further comprises a gate that is positioned adjacent the downstream end of the second magazine, and wherein the gate comprises a device selected from the group consisting of: rollers, and electronically controlled mechanical stoppers.

18. An apparatus for engaging inserts and sleeves, comprising:

a first magazine configured to stage inserts, comprising a first support surface that is positioned along a segment of a path;

a second magazine adjacent the first magazine, the second magazine being configured to stage sleeves, comprising a second support surface that is positioned along a segment of the path;

at least one lug that is configured to move along the path so as to propel a predefined number of the inserts into engagement with a lowermost sleeve;

a hopper configured to supply the second magazine with sleeves;

a supply conveyor comprising a trailing plate and a leading plate, the supply conveyor being configured to transfer a carton of items from the trailing plate to the leading plate to overturn a carton of items; and a back pressure apparatus for moving an overturned carton of items from the leading plate onto the hopper.

19. The apparatus of claim 18, wherein the hopper comprises a conveyor; and wherein the back pressure apparatus and the conveyor are controlled to move stacks of sleeves toward the second magazine.

20. The apparatus of claim 18, wherein the back pressure apparatus comprises a conveyor and at least one lug.

* * * * *